United States Patent [19]

Theurer

[11] Patent Number: 4,625,651

[45] **Date of Patent: * Dec. 2, 1986**

[54] MOBILE TRACK SWITCH LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 643,862

[22] Filed: Aug. 24, 1984

[30] Foreign Application Priority Data

Oct. 12, 1983 [AT] Austria ..... 3640/83

[51] Int. Cl.[4] ..... E01B 27/17

[52] U.S. Cl. ..... 104/7.2; 104/12

[58] Field of Search ..... 104/2, 7 R, 7 B, 12

[56] References Cited

U.S. PATENT DOCUMENTS

| | | | |
|---|---|---|---|
| 3,534,687 | 10/1970 | Plasser et al. | 104/12 |
| 3,795,198 | 3/1974 | Plasser et al. | 104/12 |
| 4,094,250 | 6/1978 | Theurer | 104/12 |
| 4,258,627 | 3/1981 | Theurer | 104/12 |
| 4,323,013 | 4/1982 | Theurer | 104/7 B |
| 4,534,295 | 8/1985 | Theurer | 104/7 B |

FOREIGN PATENT DOCUMENTS

| | | | |
|---|---|---|---|
| 1784147 | 7/1968 | Fed. Rep. of Germany | 104/7 B |

OTHER PUBLICATIONS

"Der Eisenbahningenieur", No. 6, Jun. 1983, Advertisement of 09-CSM Machine.

*Primary Examiner*—Randolph A. Reese
*Attorney, Agent, or Firm*—Kurt Kelman

[57] ABSTRACT

A mobile track switch leveling, lining and tamping machine comprises an elongated machine frame, two undercarriages spaced apart in the direction of elongation of the machine frame and supporting the machine frame for mobility on the track in an operating direction, and a respective carrier frame associated with each one of the track rails between the two undercarriages. Each carrier frame supports a tamping tool unit comprising tamping tools capable of tamping the ballast in a track switch, and a track leveling and lining unit comprising tools for lifting and laterally moving the track, the tools being capable of engaging the associated track rail in the track switch, the track leveling and lining unit preceding the tamping tool unit in the operating direction. A longitudinally adjustable coupling device pivotally links one end of each carrier frame to the elongated machine frame, and a free steering gear with a single guide wheel supports an end of each carrier frame opposite to the one end on the associated track rail.

14 Claims, 4 Drawing Figures

MOBILE TRACK SWITCH LEVELING, LINING AND TAMPING MACHINE

The present invention relates to a mobile switch leveling, lining and tamping machine for tamping ballast under respective ties of a track comprised of two rails fastened to successive ones of the ties.

Copending U.S. Pat. Nos. 4,534,295 and 4,596,193, both filed May 26 1983, disclose a continuously (non-stop) advancing track leveling, lining and tamping machine and a model of such a machine has been successfully built and operated, as reflected in an advertisement of the 09-CSM in "Der Eisenbahningenieur", No. 6, June 1983. This machine comprises an elongated machine frame supporting drive means, means for supplying power to the drive means and control means. Two undercarriages spaced apart in the direction of elongation of the machine frame support the machine frame for mobility on the track in an operating direction, and a carrier frame between the undercarriages supports a tamping tool unit and a track leveling and lining unit preceding the tamping tool unit in the operating direction, the drive and control means being connected to the tools of the units for operating the same. A longitudinally adjustable coupling device pivotally links one end of the carrier frame to the elongated machine frame, the drive and control means being connected to the coupling device for operating the same, and a free steering gear with a single guide wheel supports an end of the carrier frame opposite to the one end. The drive and control means are arranged for continuously advancing the elongated machine frame along the track in the operating direction and brake means enables the advance of the machine frame to be stopped while the drive and control means operates the coupling device for intermittent advance between successive tamping cycles for tamping ballast under respective ones of the ties at points of intersection of the two rails and the respective ties. Since the tamping tool and track leveling and lining units are arranged close to the opposite end of the carrier frame, the free steering gear guide wheels transmit a substantial portion of the weight and working forces of the tamping, leveling and lining tools to the track. Therefore, the elongated machine frame, which advances continuously with respect to the intermittently advancing carrier frame, is subjected to substantially smaller static and dynamic forces. Substantial impacts and vibrations are thus kept away from the operator's cab on the elongated machine frame, which greatly improves the operator's working conditions.

U.S. Pat. No. 3,534,687, dated Oct. 20, 1970, discloses a switch tamper with a machine frame supporting drive means, means for supplying power to the drive means, and control means, and supported on two undercarriages spaced apart in the direction of elongation of the machine frame. Two carrier frames are mounted on horizontal guide columns for displacement transversely to the track at one end of the machine frame and not between the undercarriages, the guide columns being mounted on a pivotal machine frame portion overhanging a switch to be tamped. Each carrier frame carries an operator's seat and a vertically adjustable twin tamping tool unit with tamping tools capable of tamping the ballast in a track switch. The underside of the carrier frames carries track lifting tools in the form of track clamping elements mounted on a pivotal lever. Such cantilevered track tampers do not meet present-day requirements of accuracy in the leveling and lining of track wherefore they have been generally replaced by the so-called compact machines wherein the tamping, leveling and lining tools are mounted on an elongated machine frame between the undercarriages supporting the machine frame for mobility along the track in the operating direction.

It is the primary object of this invention to provide a mobile track leveling, lining and tamping machine of the first-indicated type adapted for work in track switches by the use of proven tamping, leveling and lining tools advantageously adapted to the machine.

The above and other objects are accomplished according to the invention in such a machine by associating a respective carrier frame with each one of the track rails between the two undercarriages, each carrier frame supporting a tamping tool unit comprising tamping tools capable of tamping the ballast in a track switch, and a track leveling and lining unit comprising tools for lifting and laterally moving the track, the tools being capable of engaging the associated track rail in the track switch, the track leveling and lining unit preceding the tamping tool unit in the operating direction, and the drive and control means being connected to the tamping tools and the tools for lifting and laterally moving the track for operating the tools. A longitudinally adjustable coupling device pivotally links one end of each one of the carrier frames to the elongated machine frame, the drive and control means being connected to the coupling device for operating the same, and a free steering gear with a single guide wheel supports an end of each carrier frame opposite to the one end on the associated track rail.

The provision of two separate and independent carrier frames for the switch tamping, leveling and lining tools enables each carrier frame to be independently adjusted longitudinally so that all the tools may be properly centered for accurate operation. Since the carrier frames are considerably lighter than the entire machine, the displacement of the carriers in the direction of elongation of the machine frame during their intermittent advancement as well as for possible positional corrections can be effected very rapidly and with a relatively small expenditure of energy. Furthermore, it is possible to work on each track rail independently and without regard to the widening gauge at the initial portion of a switch so that all portions of the switch may be leveled, lined and tamped with substantially better centered tools, which is of great importance for the quality of tamping and, most particularly, leveling and lining. Furthermore, since most of the working forces of the tools on the carrier frames will be transmitted by the steering gear guide wheels to the track, the operator's cab on the elongated machine frame will be substantially free of impacts and vibrations. The working conditions for the operator will thus be substantially improved, which is of particular importance in track switch correction work which is known to be very difficult.

The above and other objects, advantages and features of the present invention will become more apparent from the following detailed description of a now preferred embodiment illustrated in the accompanying, partially schematic drawing wherein FIG. 1 is a side elevational view of a mobile track switch leveling, lining and tamping machine;

Figure 1:
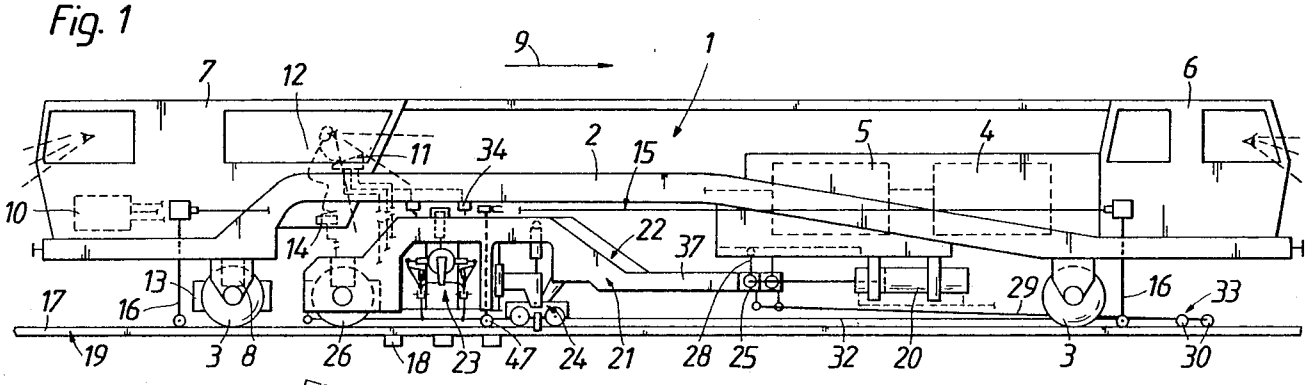

Referring to the drawing, there is shown mobile track switch leveling, lining and tamping machine 1 for tamping ballast under respective ties 18 of track 19 comprised of two rails 17 fastened to successive ones of the ties. Machine 1 comprises elongated machine frame 2 supporting a power plant 4, 5 including drive means and means for supplying power to the drive means, and control means 10. The drive means includes motor 8 for continuously advancing the machine frame on track 19 in an operating direction indicated by arrow 9. Two undercarriages 3, 3 are spaced apart in the direction of elongation of machine frame 2 and support the machine frame at respective ends thereof, the center portion of the machine frame being upwardly recessed between the undercarriages. Respective carrier frame 21, 22 is associated with each track rail 17 between the two undercarriages 3, 3 in a space defined by the upwardly recessed center portion of elongated machine frame 2. Tamping tool unit 23 comprising tamping tools 42 capable of tamping the ballast in a track switch and track leveling and lining unit 24 comprising tools 55, 52 for lifting and laterally moving the track are supported on each carrier frame. Tools 52, 55 are capable of engaging the associated track rail in the track switch, and track leveling and lining unit 24 precedes tamping tool unit 23 in the operating direction. Drive and control means 4, 5, 10 are connected to the tamping tools and the tools for lifting and laterally moving the track for operating the tools. Longitudinally adjustable coupling device 20 pivotally links one end of each carrier frame 21, 22 to elongated machine frame 2, the drive and control means being connected to the coupling devices for operating the same. Coupling devices 20 are comprised of hydraulically operated cylinder-piston drives operable for stepless longitudinal adjustment. The pivotal linkage is constituted by universal joint 25 linking an outer end of the piston rod of each drive 20 to a forward end of the respective carrier frame, each joint being supported at 28 in a guide track on machine frame 2 extending in the operating direction. Illustrated coupling devices 20 enable each carrier frame to be longitudinally positioned in dependence on the prevailing crib widths by remote control from the operator's stand. Free steering gear 26, 27 with a single guide wheel supports an end of each carrier frame 21, 22 opposite to the one end on associated track rail 17.

Front and rear operator's cabs 6 and 7 are mounted on elongated machine frame 2 and house a control panel for operating motor 8. Control panel 11 in rear operator's cab 7 is also connected to control means 10 and operator's station 12 therein is located within sight of carrier frames 21, 22 to enable an operator (outlined in broken lines) to monitor the tools visually. Brake pedal 14 at the operator's station enables the operator to actuate brake 13. As shown in the drawing, the operator's station is arranged above free steering gears 26 of the carrier frames. This arrangement enables the operator to keep the operation under constant and unrestricted visual observation to enhance his ability to center all operating tools properly, which is of particular importance in track switches to avoid damage to track parts by the operating tools. The arrangement of the operator's station above the free steering gears of the carrier frames shortens the distance between the operator and the operating tools since the carrier frames have a reduced height at the steering gears, enabling the operator's cab to be extended thereover, as clearly shown in FIG. 1.

Light beam leveling reference system 15 is arranged on the machine frame and comprises respective track level sensing elements 16, 16 running on the track rails and respectively supporting a light beam sender and receiver. The machine further comprises a lining reference system comprising two reference lines 31, 32 having respective end points and associated with a respective carrier frame 21, 22. Rail sensing device 33 carries one of the end points of each reference line 31, 32 and runs on rollers 30 along the track rails. Respective linkage 29 connects the rail sensing device to a respective carrier frame at universal joint 25 for independently displacing the rail sensing device in the direction of the track. The other end points of reference lines 31, 32 are arranged at opposite ends of carrier frames 21, 22. This relatively simple structure provides a longitudinally adjustable independent lining reference for each carrier frame, enabling the operator to select the most suitable reference for control of the lining operation.

Means 34 comprised of limit switches connecting control means 10 and coupling devices 20 enables tamping tool units 23 and track leveling and lining units 24 to advance intermittently in the operating direction while elongated frame 2 is advanced continuously by motor 8. This arrangement enables heavy machine frame 2 carrying the operator's cabs to advance continuously and smoothly during the track leveling, lining and tamping operation, thus substantially enhancing the comfort of the operating personnel. In addition, a substantial energy saving is obtained because only the lighter carrier frames need be intermittently stopped and advanced while, at the same time, the heavy machine frame receives none or little of the vibrations due to the operation of the tamping tools. In this manner, the operating efficiency of the personnel and of the machine is increased, and the tamping quality is improved because the continuous advance of the machine assures more uniform tamping. The machine may be moved continuously from tangent track into a switch and from the switch to tangent track.

Figure 2:
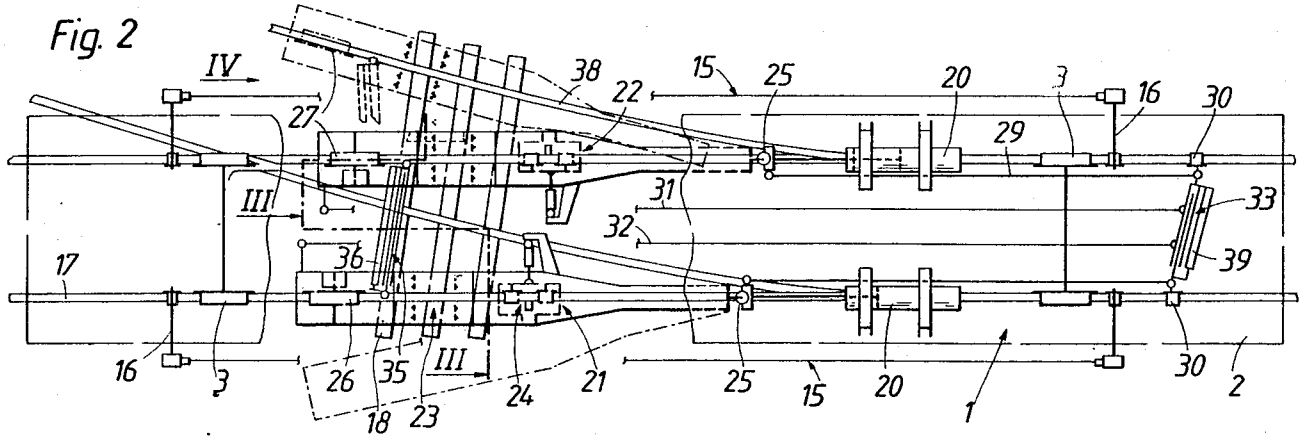
FIG. 2 is a schematically simplified top view of the machine of FIG. 1.

As will be noted from FIG. 2, transversely extending and longitudinally adjustable linkage 35 pivotally connects carrier frames 21 and 22. In the illustrated embodiment, the linkage is positioned in the range of steering gears 26 near the opposite ends of the carrier frames and hydraulically operated drive 36 is arranged for longitudinally adjusting linkage 35 for adaptation of the carrier frames to different track gauges. Drive 36 is connected to drive and control means 4, 5, 10 for operating the drive. While this arrangement assures the completely independent longitudinal adjustment and advance of each carrier frame, it provides a stable construction resistant to impact forces. Hydraulically operated adjustment drive 36 enables the two carrier frames always to be pressed against the respective rails so that the steering gears will securely guide the carrier frames along the track rails, particularly in track switches.

Each carrier frame 21, 22 is comprised of a framework overlying tamping tool unit 23 and track leveling and lining unit 24, and guide beam 37 projects from the framework and constitutes the one carrier frame end which is pivotally linked to elongated machine frame 2. This simple structure provides a very rigid frame resistant to bending forces whereby the carrier frames are able to absorb the considerable impacts generated by the track lining and lifting forces. As indicated in phantom lines in FIG. 2, carrier frames 21, 22 may be swung out at the beginning of track switch 38 about joints 25. To enable rollers 30 accurately to guide track sensing device 33 while linkages 29 independently longitudinally adjust the track sensing device, rollers 30 are interconnected by hydraulic spreading drive 39.

Figure 3:
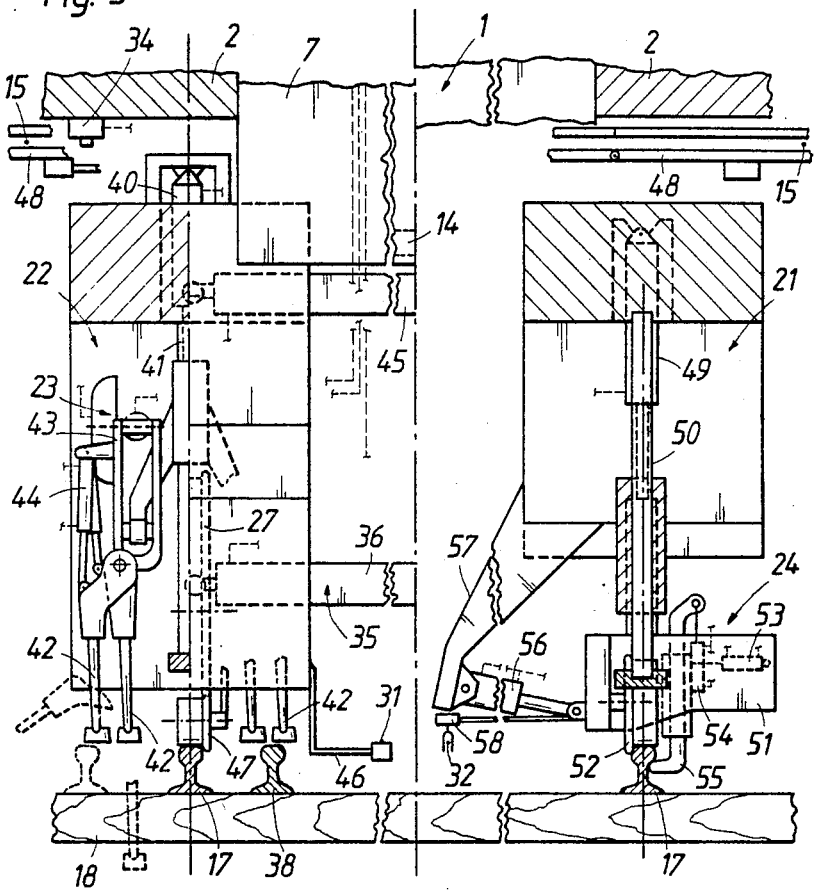
FIG. 3 is an enlarged sectional view along line III—III of FIG. 2.

FIG. 3 illustrates generally conventional tamping tool unit 23 and track leveling and lining unit 24 capable of operating in track switches. Tamping tool unit 23 is vertically adjustably mounted on guide columns 41 on each carrier frame and hydraulic drive 40 is connected to the unit for raising and lowering the unit, drive 40 extending through an opening in the carrier frame. Tamping tools 42 are laterally pivotal towards and away from associated track rail 17, the tamping tools being pivoted to the lower ends of tool holders 43 which are pivotal in the direction of the track and are connected to reciprocating and vibrating drives so that the tamping tools may be reciprocated and vibrated during the tamping operation. Respective pivoting drive 44 links each tamping tool 42 to the tool holders for independently laterally pivoting the tamping tools. As indicated by the rail shown in broken lines in FIG. 3, indicating a switch position, this arrangement enables the outer tamping tool to be pivoted upwardly out of the range of the interfering rail while the tamping tool unit is lowered to enable inner tamping tool 42 to tamp the ballast unhindered. The illustrated tamping tool unit comprises two laterally pivotal tamping tools 42 respectively arranged at the field side and the gage side of associated track rail 17, and each tamping tool is independently pivotal. This arrangement, particularly in connection with the longitudinal adjustability of the carrier frames, makes it possible to tamp even the most difficult track points at the respective intersections of the ties and rails.

The two carrier frames 21, 22 are independently guided along track 29 by steering gears 26, 27 but are linked together by linkage 35 which is adjustable longitudinally with respect to the linkage and laterally with respect to the track by drive 36. Further longitudinally adjustable linkage 45 is arranged above linkage 35 and includes means for blocking the carrier frames at a selected spacing. The blocking means is so connected to drive 36 for flow of hydraulic fluid therebetween that any longitudinal adjustment of linkage 35 due to a change in the track gauge is transmitted to the blocking means for the same adjustment of linkage 45. When drive 36 keeps the length of linkage 35 unchanged, any change in the length of linkage 45 is blocked. In this manner, the two carrier frames form a stable unit while being independently and freely movable while guided along track 19 by steering gears 26, 27.

Bracket 46 connects the rear end point of reference line 31 fixedly to carrier frame 22 for movement therewith (reference line 32 being similarly connected to carrier frame 21). Since hydraulic drive 36 presses the flanged wheels of steering gears 26, 27 without play against their associated track rails, reference lines 31,32 are accurately guided with respect to rails 17. Light beam reference system 15 comprises track level sensing roller 47 vertically movably guided on a respective carrier frame between tamping tool unit 23 and track leveling and lining unit 24. Shadowboard 48 is connected to the track level sensing roller and extends transversely to the carrier frame. The shadowboard has extensible ends whereby the shadowboard may be lengthened in the transverse direction. For example, these shadowboard ends may be hinged elements which are pivoted to extend the shadowboard. While the leveling reference system mounted on the machine frame is relatively long, the extensibility of the shadowboard enables the same to be used also in switches where one or both carrier frames are swung out from the main track to assure accurate leveling in such switches.

Track leveling and lining unit 24 is vertically adjustably mounted on guide post 50 and has frame 51 supported on the track rail by two flanged rollers 52. Laterally and horizontally adjustable lifting hook 55 is mounted on frame 51 between the flanged rollers. Drives 53 and 54 are linked to the lifting hook for lateral and horizontal adjustment thereof whereby the hook may be engaged with selected portions of the rail for lifting the track. Lining drive 56 links frame 51 to bracket 57 of the carrier frame for applying a lining force to flanged rollers 52 whereby the rollers laterally move the track. This conventional arrangement used on the carrier frames of the present invention enables the machine to be adapted to various tie positions and track obstacles. A sensing element constituted by potentiometer 58 engages reference wire 32 to provide an exact lining control (a like element being provided for engagement of reference wire 31).

Figure 4:
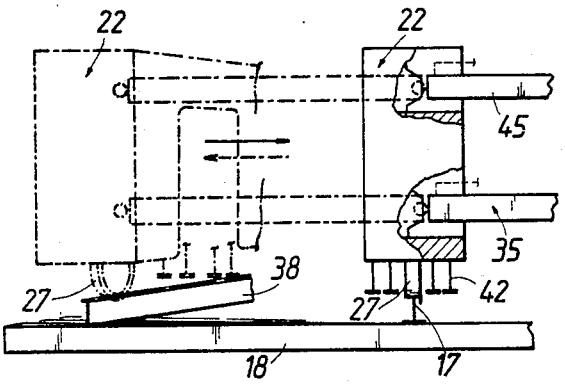
FIG. 4 is a schematically simplified end view of the machine in the direction of arrow IV of FIG. 2.

FIG. 4 shows in phantom lines the considerable freedom of lateral movement afforded to the carrier frames by the structure of this invention. This makes it possible to tamp the ballast under the outer rail of switch 38 by extending linkages 35, 45 and blocking the carrier frame in the swung-out position while machine frame 2 remains on main track 19.

The operation of track switch leveling, lining and tamping machine 1 will partly be obvious from the above description of its structure and will now be set forth in detail:

While elongated machine frame 2 is stopped and stands still, coupling devices 20 of carrier frames 21, 22 are operated to displace the carrier frames along the track until the tamping tools of tamping tool units 23 are exactly centered with respect to a tie 18 to be tamped. Lifting hook 55 is then actuated to engage associated track rail 17 either under the rail head or under the rail base, whereupon tamping unit 23 is lowered to immerse tamping tools 42 in the ballast and the immersed tamping tools are reciprocated and vibrated to tamp the ballast under tie 18. Since operator's station 12 is within visual sight of the operating tools, the operator is in an excellent position to observe all of these operations. After the tie has been tamped and while machine frame 2 remains stationary, carrier frames 21, 22 may be advanced to the next tie. If the operator sees an obstacle, he may actuate a respective drive 44 for laterally pivoting the associated tamping tool out of the way of the obstacle so that the tamping tool unit may be lowered over the next tie despite such an obstacle. As has been indicated in phantom lines in FIG. 2, the operation may also proceed so that one of the carrier frames remains guided on main track 19 while the other carrier frame is guided along the beginning of the branch line at switch 38. In this position, machine frame 2 may be advanced in the direction indicated by arrow 9 for tamping in the above-described manner. Only one of the lining reference lines 31, 32 is used for lining during these operations, the actuation of the lining drives of both units 24 being controlled by reference line sensing element 58 of the reference line being used. In tangent track, the operation proceeds with machine frame 2 advancing nonstop along the track while means 34 intermittently advances the carrier frames from tamping cycle to tamping cycle by automatically actuating hydraulic cylinder-piston devices 20.

What is claimed is:

1. A mobile track switch leveling, lining and tamping machine for tamping ballast under respective ties of a track comprised of two rails fastened to successive ones of the ties, which comprises (a) an elongated machine frame supporting drive means, means for supplying power to the drive means, and control means, (b) two undercarriages spaced apart in the direction of elongation of the machine frame and supporting the machine frame for mobility on the track in an operating direction, (c) a respective carrier frame associated with each one of the track rails between the two undercarriages, each carrier frame supporting (1) a tamping tool unit comprising tamping tools capable of tamping the ballast in a track switch, and (2) a track leveling and lining unit comprising tools for lifting and laterally moving the track, the tools being capable of engaging the associated track rail in the track switch, the track leveling and lining unit preceding the tamping tool unit in the operating direction, and the drive and control means being connected to the tamping tools and the tools for lifting and laterally moving the track for operating the tools, (d) a longitudinally adjustable coupling device pivotally linking one end of each one of the carrier frames to the elongated machine frame, the drive and control means being connected to the coupling device for operating the same, and (e) a free steering gear with a single guide wheel supporting an end of each carrier frame opposite to the one end on the associated track rail.

2. The mobile track switch leveling, lining and tamping machine of claim 1, wherein each one of the coupling devices is comprised of a hydraulically operated cylinder-piston drive operable for stepless longitudinal adjustment.

3. The mobile track switch leveling, lining and tamping machine of claim 1, further comprising a transversely extending linkage pivotally connecting the carrier frames, the linkage being adjustable longitudinally with respect to the linkage and laterally with respect to the track.

4. The mobile track switch leveling, lining and tamping machine of claim 3, wherein the linkage is positioned in the range of the steering gears near the opposite ends of the carrier frames.

5. The mobile track switch leveling, lining and tamping machine of claim 3, further comprising a hydraulically operated drive for longitudinally adjusting the linkage for adaptation of the carrier frames to different track gauges, the drive being connected to the drive and control means for operating the drive.

6. The mobile track switch leveling, lining and tamping machine of claim 3, comprising a further longitudinally adjustable linkage connecting the carrier frames, the further linkage being arranged above the first-named linkage and including means for blocking the carrier frames at a selected spacing.

7. The mobile track switch leveling, lining and tamping machine of claim 1, wherein the drive means comprises a drive continuously advancing the elongated frame in the operating direction and the coupling device constitutes means for intermittently advancing the tamping tool unit and the track leveling and lining unit in the operating direction while the elongated frame is advanced continuously, the drive and control means being connected to the drive for continuously advancing the elongated frame for operating the advancing drive.

8. The mobile track switch leveling, lining and tamping machine of claim 1, further comprising an operator's cab housing a control panel for operating the drive and control means and an operator's station located therein to enable an operator to monitor the tools visually, the cab being mounted on the elongated machine frame and the station being within sight of the carrier frames.

9. The mobile track switch leveling, lining and tamping machine of claim 8, wherein the operator's station is arranged above the free steering gears of the carrier frames.

10. The mobile track switch leveling, lining and tamping machine of claim 1, wherein each tamping tool unit comprises two of said laterally pivotal tamping tools respectively arranged at the field side and the gage side of the associated track rail, each one of the tamping tools being independently pivotal.

11. The mobile track switch leveling, lining and tamping machine of claim 1, wherein the track lifting tools are vertically and horizontally adjustable lifting hooks and the tools for laterally moving the track are flanged rollers.

12. The mobile track switch leveling, lining and tamping machine of claim 1, wherein each one of the carrier frames is comprised of a framework overlying the tamping tool unit and the track leveling and lining unit, and a guide beam projecting from the framework and constituting the one carrier frame end.

13. The mobile track switch leveling, lining and tamping machine of claim 1, further comprising a lining reference system comprising two reference lines having respective end points and associated with a respective one of the carrier frames, a rail sensing device carrying one of the end points of each one of the reference lines, and a respective linkage connecting the rail sensing device to a respective one of the carrier frames for independently displacing the rail sensing device in the direction of the track, the other end points of the reference lines being arranged at opposite ends of the carrier frames.

14. The mobile track switch leveling, lining and tamping machine of claim 1, further comprising a light beam leveling reference system comprising a track level sensing roller vertically movably guided on a respective one of the carrier frames between the tamping tool unit and the track leveling and lining unit, and a shadowboard connected thereto and extending transversely to the carrier frame, the shadowboard having extensible ends whereby the shadowboard may be lengthened.

* * * * *